United States Patent [19]

Roussel et al.

[11] Patent Number: 5,059,301

[45] Date of Patent: Oct. 22, 1991

[54] PROCESS FOR THE PREPARATION OF RECARBURIZER COKE

[75] Inventors: Keith M. Roussel, Ponca City, Okla.; John K. Shigley, Ogden, Utah

[73] Assignee: Conoco, Ponca City, Okla.

[21] Appl. No.: 672,504

[22] Filed: Mar. 20, 1991

Related U.S. Application Data

[63] Continuation-in-part of Ser. No. 277,163, Nov. 29, 1988.

[51] Int. Cl.[5] ..... C10G 69/02

[52] U.S. Cl. ..... 208/50; 208/57; 208/93; 208/131

[58] Field of Search ..... 208/50, 57, 93, 131, 208/58

[56] References Cited

U.S. PATENT DOCUMENTS

| | | | |
|---|---|---|---|
| 3,830,731 | 8/1974 | Reed et al. | 208/211 |
| 4,075,084 | 2/1978 | Skripek et al. | 208/50 |
| 4,178,229 | 12/1979 | McConaghy et al. | 208/50 |
| 4,213,846 | 7/1980 | Sooter et al. | 208/93 |
| 4,720,338 | 1/1988 | Newman et al. | 208/131 |

*Primary Examiner*—Curtis R. Davis
*Assistant Examiner*—William C. Diemler
*Attorney, Agent, or Firm*—Cleveland R. Williams; Henry H. Huth

[57] ABSTRACT

Recarburizer coke containing not more than 0.1 weight percent sulfur and not more than 0.1 weight percent nitrogen is prepared by severe catalytic hydrotreating, followed by thermal cracking, and delayed coking of vacuum gas oil obtained from the vacuum distillation of FCC decant oil.

15 Claims, 1 Drawing Sheet

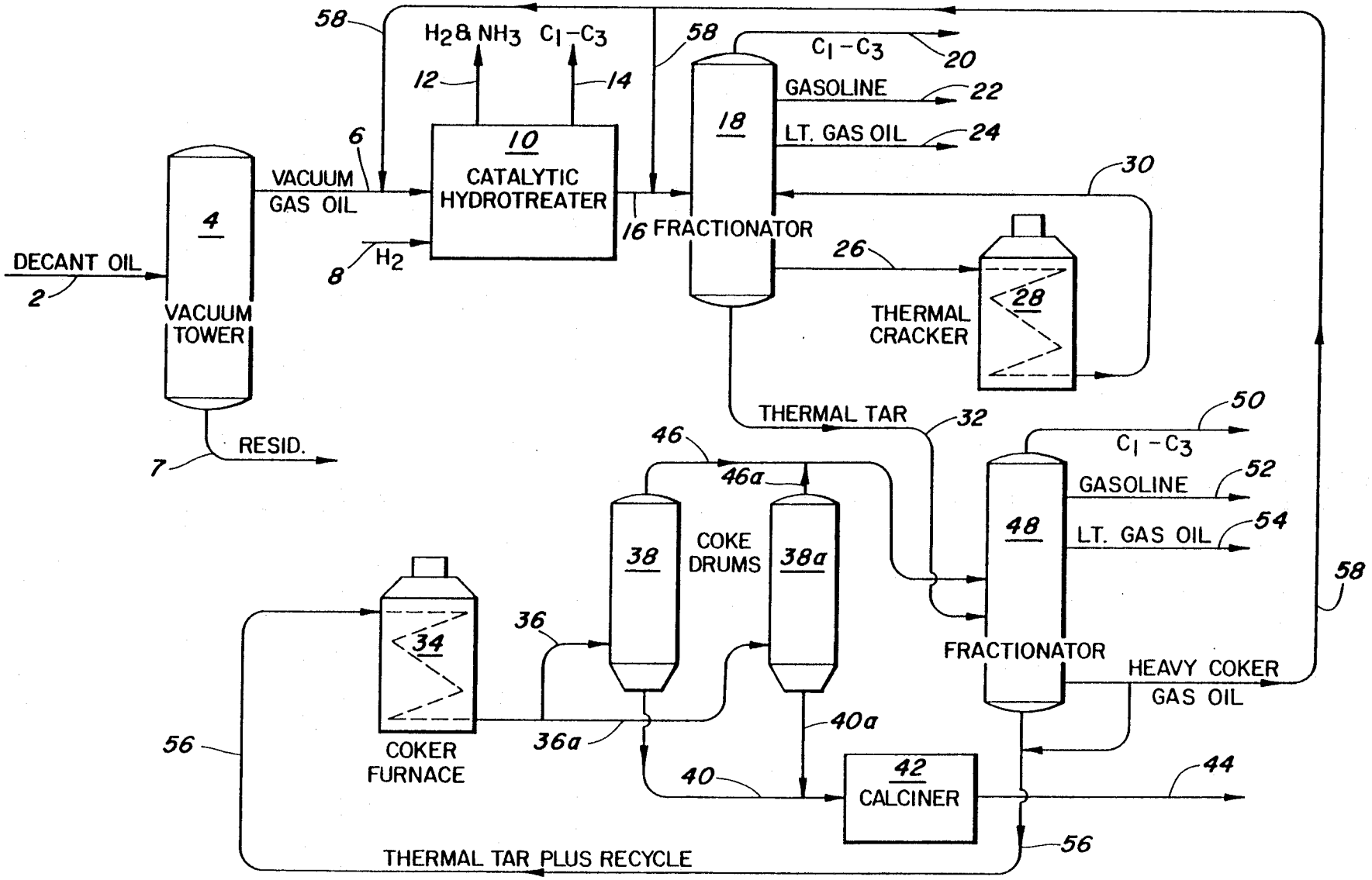
DECANT OIL
2
4
VACUUM TOWER
RESID.
7
VACUUM GAS OIL
6
H2
8
10
CATALYTIC HYDROTREATER
12
H2S & NH3
14
C1 - C3
58
16
FRACTIONATOR
18
C1 - C3
20
GASOLINE
22
LT. GAS OIL
24
26
THERMAL CRACKER
28
30
THERMAL TAR
32
34
COKER FURNACE
36
36a
38
COKE DRUMS
38a
46
46a
40
40a
42
CALCINER
44
48
FRACTIONATOR
C1 - C3
50
GASOLINE
52
LT. GAS OIL
54
HEAVY COKER GAS OIL
56
THERMAL TAR PLUS RECYCLE
58

PROCESS FOR THE PREPARATION OF RECARBURIZER COKE

This is a continuation-in-part of application Ser. No. 07/277,163, filed on Nov. 29, 1988, entitled A Process For The Preparation Of Recarburizer Coke.

BACKGROUND AND SUMMARY OF THE INVENTION

Low sulfur recarburizer coke is a type of coke used in the production of high quality steels. Its purpose is to increase the carbon content of the steel without introducing any extraneous contaminants, especially sulfur and nitrogen. Historically, steel producers and recarburizer marketers have used crushed scrap graphite (graphitized premium coke) as the major source of recarburizer coke. However, this source has steadily declined as scrap rates in the graphite electrode production, and electric arc furnaces have been reduced. A market now exists for alternative sources of recarburizer coke with very low levels of contaminants.

It would be possible, of course, to manufacture high quality, premium coke, calcine and graphitize this material and use it as recarburizer coke. However, such premium coke is too valuable in its use for electrodes in the manufacture of steel and, it would not be profitable to use this material as recarburizer coke. Prior to graphitization, premium coke usually contains substantial amounts of sulfur and nitrogen, up to 0.3 to 0.5 or higher weight percent sulfur and nitrogen in similar quantities. Thus, ungraphitized premium coke would not be suitable for use as recarburizer coke even if economics would permit its use. Another type of coke which is manufactured in substantial quantities is so called aluminum grade coke, that is, coke which is used in manufacturing electrodes for use in the production of aluminum. This coke also contains substantial amounts of sulfur and nitrogen which make it unsuitable for use as recarburizer coke.

It has been found that FCC decant oil (also known as slurry oil or clarified oil) can be processed to produce recarburizer coke. In order to use decant oil for this purpose it must first be subjected to catalytic hydrotreating to reduce its sulfur and nitrogen content. Unfortunately the severe hydrotreating conditions which are required to produce a feed material of reduced sulfur and nitrogen content, suitable for making recarburizer coke, rapidly deactivate the hydrotreating catalyst. This results in a major decrease in catalyst life and increasing cost of the operation.

In accordance with this invention, FCC decant oil is subjected to vacuum distillation to separate it into two fractions, a vacuum gas oil in which sulfur and nitrogen are concentrated and a heavy residuum containing materials which tend to coke under severe hydrotreating conditions. The vacuum gas oil is catalytically hydrotreated under severe conditions to reduce the sulfur and nitrogen content to low levels; the hydrotreated product is then thermally cracked to provide a thermal tar which is subjected to delayed coking and the delayed coke is calcined to provide a recarburizer coke product containing not more than 0.1 weight percent sulfur and not more than 0.1 weight percent nitrogen.

THE PRIOR ART

U.S. Pat. No. 4,075,084 teaches a method for producing low sulfur needle coke by fractionally distilling feedstocks, concentrating asphaltenes in the bottoms fraction while subjecting an overhead fraction to catalytic hydrofining to effect desulfurization without raising the hydrogen content, and blending the 600° F.+ fraction from the hydrofiner (the coke-forming fraction) with the bottoms fraction to form a coking feedstock containing low asphaltenes and thereafter delay coking the feedstock.

U.S. Pat. No. 4,213,846 shows a delayed premium coking process comprising fractionating a conventional premium coking feedstock into a gas oil fraction and a bottom fraction, the bottom fraction being a coker feedstock. The gas oil fraction is hydrotreated and then remixed with the coker feedstock.

U.S. Pat. No. 4,178,229 shows a process for producing premium coke from a vacuum residuum comprising fractionating the residuum into a gas oil fraction and a pitch fraction, hydrotreating the gas oil fraction, and combining a portion of the hydrotreated gas oil fraction with the pitch fraction to form a coker feedstock.

U.S. Pat. No. 3,830,731 shows the desulfurization of vacuum resids by fractionating to resid and gas oil fractions. Each fraction is hydrotreated separately, and the separately hydrotreated fractions are recombined to form a gas oil feedstock.

BRIEF DESCRIPTION OF THE DRAWING

The drawing is a schematic diagram of a process unit which illustrates the invention.

DETAILED DESCRIPTION OF THE INVENTION

The decant oils used in the process of the invention are heavy residual oils which are a by-product of FCC (fluidized catalytic cracking) operations. These materials usually have an API gravity of about −4 to about 7 and a boiling range of about 650 to about 950 (90% recovery)°F. The most readily available decant oils and those to which this invention is directed are those which contain more than 1.0 weight percent sulfur and a significant amount of nitrogen, i.e. about 0.5 weight percent or more. These contaminants must be substantially removed, i.e. to a level of not more than 0.10 weight percent sulfur and not more than 0.10 weight percent nitrogen before a high quality recarburizer coke can be produced from the decant oil.

Referring now to the drawing, decant oil is introduced to vacuum tower 4 where this material is separated into two fractions, a lighter fraction in which the sulfur and nitrogen are generally concentrated and a heavy fraction containing highly aromatic, high molecular weight materials which form coke at the severe hydrotreating conditions employed in the process of the invention. The lighter fraction, vacuum gas oil, is withdrawn from the vacuum tower through line 6 and the heavy fraction, a heavy residuum, is removed via line 7.

In the vacuum tower it is convenient to separate a vacuum gas oil fraction boiling below about 1000° F. and a 1000° F.+ residuum, however, lesser or greater amounts of the decant oil feed may be recovered in the vacuum gas oil fraction, if desired. The vacuum gas oil may have maximum boiling point as low as 850° F. or as high as 1050° F. Preferably sufficient heavy material is retained in the residuum to hold catalyst fouling to a minimum during hydrotreating of the vacuum gas oil.

The vacuum tower is usually operated at an absolute pressure of between about 10 and about 100 mm of mercury and a temperature of between about 700° and about 800° F. The vacuum gas oil product will vary from about 60 to about 95 percent of the decant oil feed, depending on the composition of such feed.

Referring again to the drawing, the vacuum gas oil from vacuum tower 4 is directed to catalytic hydrotreater 10 via line 6, with hydrogen being introduced to the hydrotreater through line 8. The catalyst used in hydrotreater 4 comprises a hydrogenation component deposited on a suitable inert carrier. Examples of the various hydrogenation components include the metals, salts, oxides, or sulfides of the metals of periodic groups 8 and 6B, for example, chromium, molybdenum, tungsten, iron, cobalt, nickel, ruthenium, rhodium, palladium, osmium, iridium, and platinum. The particular catalyst employed is not critical to the invention and any of the conventional catalysts used for hydrotreating can be employed.

These catalysts are typically distended on a suitable inert support of carbon, for example, activated carbon or a dried and calcined gel of an amphoteric metal oxide, for example, alumina, titania, thoria, silica, or mixtures thereof. The most commonly employed carriers are the silica and alumina-containing carriers or mixtures thereof.

The hydrotreating process conditions used are much more severe than are ordinarily used, employing a much higher pressure, and may be summarized as follows:

| | Hydrotreating Conditions | |
|---|---|---|
| | Broad Range | Preferred Range |
| Temperature - °F. | about 600–850 | about 700–800 |
| Pressure - psig | about 1000–2500 | about 1800–2400 |
| $H_2$/Oil - SCFB | about 2000–4000 | about 3000–4000 |
| LHSV | about 0.2–2.0 | about 0.5–1.5 |

The specific process conditions employed for hydrotreating will depend on the particular decant oil which is used as feedstock. For purposes of the present invention, the critical hydrotreating requirements are that the overall conditions must be selected to effect sufficient desulfurization of the feed and removal of nitrogen from the feed to provide a recarburizer coke product containing not more than 0.1 weight percent sulfur and not more than 0.1 weight percent nitrogen, and preferably not more than 0.05 weight percent sulfur and not more than 0.05 weight percent nitrogen.

The sulfur and nitrogen which are removed from the combined feed in the hydrotreating step are taken overhead from the catalytic hydrotreater through line 12. The sulfur is removed as hydrogen sulfide and the nitrogen usually in the form of ammonia. In addition, light gases $C_1$ to $C_3$ are removed from the catalytic hydrotreater through line 14. The remaining liquid effluent from the catalytic hydrotreater is transferred via line 16 to a first fractionator 18 from which light gases, gasoline, and light gas oil are taken off overhead or as side products through lines 20, 22 and 24, respectively. A heavy material usually having a boiling range above about 550° F. is removed from fractionator 18 through line 26 and introduced to thermal cracker 28. In thermal cracker 28, temperatures of about 900° to 1100° F. and pressures of about 300 to 800 psig are maintained whereby this heavy material is converted to lighter compounds and to a thermal tar containing less hydrogen, higher aromatics and a higher carbon residue than the feed to the thermal cracker. Effluent from the thermal cracker is then recycled via line 30 to fractionator 18.

A thermal tar which comprises a major portion of coking components is withdrawn from the bottom of fractionator 18 through line 32 and introduced to a second fractionator 48 wherein it is mixed with the coke drum overhead vapors entering the fractionator through lines 46 and 46A. It should be noted that the first and second fractionators are operated using conventional conditions of temperature and pressure. The combined feed (thermal tar plus recycle) is withdrawn from fractionator 48 through line 56 and introduced to the coker furnace wherein it is heated to temperatures in the range of about 875° to 975° F. at pressures from about atmospheric to about 250 psig and is then passed via line 36 to coke drums 38 and 38A. The coke drums operate on alternate coking and decoking cycles of about 16 to about 100 hours; while one drum is being filled with coke the other is being decoked. During the coking cycle, each drum operates at a temperature between about 850° and about 950° F. and a pressure from about 15 to about 200 psig. As mentioned above, the overhead vapor from the coke drum is passed via line 46 or 46A to fractionator 48. At the same time coke is removed from the bottom of the coke drums through outlet 40 or 40A. The material entering fractionator 48 is separated into several fractions, a gaseous material which is removed through line 50, a gasoline fraction removed through line 52 and a light gas oil which is removed via line 54. Heavy coker gas oil is removed from fractionator 48 and is sent to storage or recycled to the hydrotreater inlet or to the thermal cracker through line 58. If desired, a portion or all of this material may instead be used as recycle to the coker and returned to the coker furnace 34 through line 56.

The green coke which is removed from the coke drums through outlets 40 and 40A is introduced to calciner 42 where it is subjected to elevated temperatures to remove volatile materials and to increase the carbon to a hydrogen ratio of the coke. Calcination may be carried out at temperatures in the range of between about 2000° and about 3000° F. and preferably between about 2400° and about 2600° F. The coke is maintained under calcining conditions for between about ½ hour and about 10 hours and preferably between about 1 and about 3 hours. The calcined coke which contains less than 0.1 percent sulfur and less than 0.1 percent nitrogen and preferably less than 0.05 percent sulfur and less than 0.05 percent nitrogen is withdrawn from the calciner through outlet 44 and is suitable for use as recarburizer coke.

The following example illustrates the results obtained in carrying out the invention.

EXAMPLE 640 barrels/hr of an FCC decant oil having an API gravity of −1.0, a boiling range of 650° F. to 950° F. (90% recovery) and containing 1.2 weight percent sulfur and 0.5 weight percent nitrogen is introduced to a vacuum tower maintained at a pressure of 30 mm mercury and a temperature of 735° F. A vacuum gas oil stream in the amount of 570 bbls/hr boiling below 1000° F. is removed from the vacuum tower and subjected to hydrotreating in the presence of a cobalt-molybdenum catalyst at a temperature of 750° F., a pressure of 2000 psig, a hydrogen to oil ratio of 3000 SCFB and an LHSV of 0.8 1/hr. The hydrotreated feed is introduced to a fractionator where light fractions, e.g. gas, gasoline and light gas oil are removed. 450 barrels/hr of a heavy fraction having a boiling range of 500° to 1000° F. is removed from the lower portion of the fractionator and passed through a thermal cracking furnace maintained at a temperature of 910°-950° F. and a pressure of 400 psig. The cracked effluent from the furnace is returned to the fractionator. A thermal tar having an API gravity of −1.0 and an initial boiling point of 650° F. is withdrawn from the bottom of the fractionator at a rate of 360 barrels/hr and sent to a coker fractionator wherein it is mixed with the coker overhead. The combined feed (thermal tar plus recycle) is introduced to a coker furnace maintained at a temperature of 945° F. and a pressure 200 psig. Effluent from the coker furnace is introduced to delayed cokers operating in sequence wherein coking is carried out at a temperature of 875° F. and a pressure of 60 psig for 24 hours. Green coke in the amount of 18 tons per hour is then removed from the delayed cokers and is calcined at 2500° F. for 1.0 hours to provide 15.3 tons/hr of recarburizer coke having a sulfur content of 0.1 weight percent and a nitrogen content of 0.05 weight percent.

The non-coke effluent from the delayed coker is taken to the coker fractionator where various fractions, including $C_1$ to $C_3$ gases, gasoline and light gas oil are recovered. Heavy gas oil bottoms from this fractionator in the amount of 180 barrels/hr is recycled with the thermal tar to the coker furnace.

This operation is carried out for several months without substantial deactivation of the hydrotreating catalyst.

While certain embodiments and details have been shown for the purpose of illustrating the present invention, it will be apparent to those skilled in this art that various changes and modifications may be made herein without departing from the spirit or scope of the invention.

We claim:

1. A process for the production of low sulfur and low nitrogen coke which comprises:
   (a) subjecting a decant oil containing substantial amounts of sulfur and nitrogen to vacuum distillation to obtain a vacuum gas oil fraction in which the sulfur and nitrogen is concentrated, wherein said vacuum gas oil fraction has a boiling point below about 1000° F. and a residuum having a boiling point above about 1000° F.,
   (b) subjecting the vacuum gas oil to severe hydrotreating conditions to obtain a product containing reduced sulfur and nitrogen,
   (c) subjecting the hydrotreated product to fractionation in a first fractionator to produce a light hydrocarbon fraction, a heavy gas oil fraction and a thermal tar fraction,
   (d) combining the thermal tar from step (c) with overhead hydrocarbon vapors from a coke drum to produce a mixture and subjecting said mixture to fractionation in a second fractionator to produce a heavy coker gas oil fraction and a thermal tar fraction; and
   (e) subjecting the thermal tar from step (d) to delayed coking to produce a coke product.

2. The process according to claim 1 wherein the heavy gas oil fraction from step (c) is subjected to thermal cracking and the effluent from the thermal cracker is recycled to the first fractionator.

3. The process according to claim 1 wherein the heavy coker gas oil from step (d) is recycled and combined with the vacuum gas oil fraction of step (a).

4. A process of claim 1 wherein the heavy coker gas oil from step (d) is recycled and combined with the hydrotreated product of step (b).

5. The process according to claim 1 wherein the coke product contains not more than 0.10 weight percent sulfur and not more than 0.10 weight percent nitrogen.

6. The process according to claim 1 wherein the hydrotreating in step (b) is conducted at a temperature of 600° F. to about 850° F. a pressure of about 1000 psig to about 2500 psig, a hydrogen to oil ratio of about 3000 to about 4000 SCFB and a LHSV of from about 0.2 to about 2.0.

7. The process according to claim 1, wherein the coke product from step (e) is calcined to obtain recarburizer coke product containing not more than 0.05 weight percent sulfur and not more than 0.05 weight percent nitrogen.

8. A process for the production of low sulfur and low nitrogen recarburizer coke which comprises:
   (a) subjecting a decant oil containing more than 1.0 weight percent sulfur and more than 1.0 weight percent nitrogen to vacuum distillation to obtain a vacuum gas oil fraction having a boiling point below about 1050° F. and a residuum having a boiling point above about 1000° F.,
   (b) subjecting the vacuum gas oil to severe hydrotreating conditions at a temperature of 700° F. to 800° F., a pressure of 1800 psig to 2400 psig, a hydrogen to oil ratio of 3000 to 4000 SCFB and a LHSV of 0.5 to 1.5 to obtain a product containing reduced sulfur and nitrogen,
   (c) subjecting the hydrotreated product to fractionation in a first fractionator to produce a light hydrocarbon fraction, a heavy gas oil fraction and a thermal tar fraction,
   (d) combining the thermal tar fraction from step (c) with overhead hydrocarbon vapors from a coke drum to produce a mixture and subjecting said mixture to fractionation in a second fractionator to produce a heavy coker gas oil fraction and a thermal tar fraction,
   (e) subjecting the thermal tar from step (d) to delayed coking to produce a coke product; and
   (f) recovering a coke product containing not more than 0.10 weight percent sulfur and not more than 0.10 weight percent nitrogen.

9. The process according to claim 8 wherein the heavy gas oil fraction from step (c) is subjected to thermal cracking and the efflent from the thermal cracker is recycled to the first fractionator.

10. The process according to claim 8 wherein the heavy coker gas oil from step (d) is recycled and combined with the vacuum gas oil fraction of step (a).

11. The process of claim 8 wherein the heavy coker gas oil from step (d) is recycled and combined with the hydrotreated product of step (b).

12. The process of claim 8 wherein the thermal cracking is conducted at a temperature of from about 900° F. to about 1100° F. and a pressure of from about 300 psig to about 800 psig.

13. The process according to claim 8 wherein the delayed coking is conducted at a temperature of from about 850° F. to about 950° F., a pressure of from about 15 psig to about 200 psig and a coking cycle of from about 16 hours to about 100 hours.

14. The process according to claim 8 wherein the effluent from the hydrotreating in step (b) contains less than about 0.10 weight percent sulfur and less than about 0.10 weight percent nitrogen.

15. The process of claim 8 wherein the vacuum gas oil of step (a) has a maximum boiling point of from about 850° F. to about 1050° F.

* * * * *